US010129943B2

(12) United States Patent
Li et al.

(10) Patent No.: US 10,129,943 B2
(45) Date of Patent: Nov. 13, 2018

(54) DIMMABLE LED MODULE AND METHOD OF USING SAME

(71) Applicant: TAOLIGHT COMPANY LIMITED, Hong Kong (CN)

(72) Inventors: Huahui Li, Hong Kong (CN); Bertrand Delalande, Hong Kong (CN); Jerome Leroy, Shanghai (CN); Libo Wu, Hong Kong (CN)

(73) Assignee: TAOLIGHT COMPANY LIMITED, Hong Kong (CN)

( * ) Notice: Subject to any disclaimer, the term of this patent is extended or adjusted under 35 U.S.C. 154(b) by 0 days.

(21) Appl. No.: 15/505,875

(22) PCT Filed: Oct. 28, 2014

(86) PCT No.: PCT/CN2014/089730
§ 371 (c)(1),
(2) Date: Feb. 22, 2017

(87) PCT Pub. No.: WO2016/065539
PCT Pub. Date: May 6, 2016

(65) Prior Publication Data

US 2017/0245336 A1 Aug. 24, 2017

(51) Int. Cl.
*H05B 37/00* (2006.01)
*H05B 33/08* (2006.01)
(Continued)

(52) U.S. Cl.
CPC ..... *H05B 33/0845* (2013.01); *H05B 33/0857* (2013.01); *H05B 37/0281* (2013.01);
(Continued)

(58) Field of Classification Search
CPC ..... H05B 33/0815; H05B 33/0818; H05B 41/2828; H05B 41/3921; H05B 41/3927;
(Continued)

(56) References Cited

U.S. PATENT DOCUMENTS 7,740,371 B1 * 6/2010 Lebens ..... F21L 4/027 315/127
2005/0162101 A1 7/2005 Leong et al.
(Continued)

FOREIGN PATENT DOCUMENTS

CN 101996587 B 6/2013
CN 103747576 A 4/2014

OTHER PUBLICATIONS

International Search Report, dated Jul. 16, 2015, for PCT/CN2014/089730, 4 pages.
(Continued)

*Primary Examiner* — Minh D A
(74) *Attorney, Agent, or Firm* — Seed IP Law Group LLP

(57) ABSTRACT

A dimmable LED module configured for electrical connection with an AC mains power supply via a switch (9), the dimmable lighting module including a plurality of activatable LED light sources configured for emitting a corresponding lighting characteristic when activated, and, a control unit (4) configured for selectably activating at least one of the plurality of LED light sources in response to a control signal generated by a predetermined switching operation of the switch (9) that is received by the control unit (4) such that a plurality of lighting modes are able to be selectably output from the dimmable LED module corresponding to the at least one of the plurality of LED light sources that are selectably activated by the control unit (4), the plurality of lighting modes being indicative of a resulting lighting characteristic emitted by the at least one of the plurality of selectably activated LED light sources corresponding to the lighting modes, wherein the plurality of lighting modes include at least a first lighting mode and a second lighting mode whereby the second lighting mode is indicative of a
(Continued)

resulting lighting characteristic that is relatively dimmed compared to that of the first lighting mode.

18 Claims, 2 Drawing Sheets

(51) Int. Cl.

| | |
|---|---|
| ***H05B 37/02*** | (2006.01) |
| *F21V 29/74* | (2015.01) |
| *F21Y 115/10* | (2016.01) |
| *F21V 3/00* | (2015.01) |
| *F21K 9/235* | (2016.01) |
| *F21K 9/238* | (2016.01) |

(52) U.S. Cl.
CPC ..... *F21K 9/235* (2016.08); *F21K 9/238* (2016.08); *F21V 3/00* (2013.01); *F21V 29/74* (2015.01); *F21Y 2115/10* (2016.08)

(58) Field of Classification Search
CPC .. H05B 37/029; H05B 37/02; H05B 37/0254; H05B 33/0803; H05B 33/0827; H05B 33/0851; F21Y 2101/02
See application file for complete search history.

(56) References Cited

U.S. PATENT DOCUMENTS

| | | | | |
|---|---|---|---|---|
| 2010/0194308 | A1* | 8/2010 | Zhao | H05B 33/0815 315/297 |
| 2011/0199753 | A1* | 8/2011 | Ramer | F21K 9/00 362/84 |
| 2013/0050297 | A1* | 2/2013 | Fratti | G09G 3/3426 345/691 |
| 2013/0093357 | A1 | 4/2013 | Lee et al. | |
| 2013/0278162 | A1 | 10/2013 | Watson et al. | |
| 2014/0268772 | A1 | 9/2014 | Richards et al. | |

OTHER PUBLICATIONS

Written Opinion, dated Jul. 16, 2015, for PCT/CN2014/089730, 5 pages.

* cited by examiner

DIMMABLE LED MODULE AND METHOD OF USING SAME

TECHNICAL FIELD

The present invention relates to the field of dimmable LED lighting units

BACKGROUND OF THE INVENTION

Dimmers for luminaire systems are used for various applications including to create different lighting modes and for energy saving purposes.

Certain existing luminaire systems provide for light dimming and colour temperature adjustment by utilising several different luminaires systems which, in combination, are used to illuminate a given area with a desired lighting effect. However, this approach introduces additional inconvenience and complexity in terms of having to install the different luminaire systems and their respective separate control interfaces, and then, having to separately synchronise control each of the different luminaire systems to produce the desired lighting effect.

Existing luminaire systems such as incandescent lamps, fluorescent lamps and compact fluorescent lamp (CFL), also utilise phase-cut dimmers to effect dimming which must either be installed in a wall or ceiling, or, which must be integrally manufactured in a portable luminaire unit. In addition to the costs and complexities of installing the phase-cut dimmer, such existing luminaire systems will also require the use of specialised internal control units and/or integrated control interfaces, for instance, typically in the form of a bespoke wall switch control panel, an infra-red (IR) or radio-frequency (RF) remote controller, a smart phone software application, or specialised control cables compatible with protocols such as DALI (Digital Addressable Lighting Interface) or DMX512 and so on. As such, the installation of the phase-cut dimmer, internal control units, control interfaces, and control cables requires additional mounting and electrical wiring which is inconvenient, unduly complex and costly for existing installations which do not have an existing dimmer and control set-up.

SUMMARY OF THE INVENTION

The present invention seeks to alleviate at least one of the above-described problems.

The present invention may involve several broad forms. Embodiments of the present invention may include one or any combination of the different broad forms herein described.

In a first broad form, the present invention provides a dimmable LED module configured for electrical connection with an AC mains power supply via a switch, the dimmable lighting module including:

a plurality of activatable LED light sources configured for emitting a corresponding lighting characteristic when activated; and a control unit configured for selectably activating at least one of the plurality of LED light sources in response to a control signal generated by a predetermined switching operation of the switch that is received by the control unit such that a plurality of lighting modes are able to be selectably output from the dimmable LED module corresponding to the at least one of the plurality of LED light sources that are selectably activated by the control unit, the plurality of lighting modes being indicative of a resulting lighting characteristic emitted by the at least one of the plurality of selectably activated LED light sources corresponding to the lighting modes;

wherein the plurality of lighting modes include at least a first lighting mode and a second lighting mode whereby the second lighting mode is indicative of a resulting lighting characteristic that is relatively dimmed compared to that of the first lighting mode.

Preferably, the resulting lighting characteristic of the second lighting mode that is relatively dimmed compared to that of the first lighting mode may include at least one of a brightness and a colour temperature of the second lighting mode.

Preferably, the plurality of LED light sources may be configured for emitting different corresponding lighting characteristic when activated.

Preferably, at least one of the plurality of LED light sources may include a string of electrically-connected LEDs configured to be activated simultaneously.

Preferably the present invention may include a plurality of lighting modes each being indicative of resulting lighting characteristics that are dimmed to different magnitudes relative to that of the first lighting mode.

Preferably, the switch may include an on/off switch and the predetermined switching operation may be include toggling the on/off switch between an on and off state in accordance with a predetermined timing protocol.

Preferably, in response to the control signal generated by a predetermined switching operation of the switch, the control unit may be configured to sequentially output the plurality of lighting modes from the dimmable LED module for user selection, said sequential output including in order of increasing or decreasing magnitude of dimming of the resulting lighting characteristic relative to that of the first lighting mode.

Preferably, the resulting lighting characteristic indicated by the first lighting mode may include a lighting characteristic of a cool white LED light source that is selectably activated from amongst the plurality of LED light sources, and, the resulting lighting characteristic indicated by the second lighting mode includes a lighting characteristic of a warm white LED light source that is selectably activated from amongst the plurality of LED light sources.

Preferably, in response to a control signal generated by a predetermined switching operation of the switch that is received by the control unit, the control unit may be configured for selectably activating at least one of the plurality of LED light sources such that a plurality of mood lighting modes are able to be selectably output from the dimmable LED module corresponding to the at least one of the plurality of LED light sources that are selectably activated, the plurality of mood lighting modes being indicative of a resulting lighting characteristic emitted by the at least one of the plurality of selectably activated LED light sources corresponding to the mood lighting modes.

Preferably, the control unit may include a power supply driver circuit for driving the plurality of LED light sources.

Preferably, the plurality of LED light sources may include at least one of a common thermal dissipation unit, a common optical unit and a common driver circuit unit.

Preferably, the dimmable LED module may be configured as a compact and/or portable lighting module.

In a second broad form, the present invention provides a method for providing dimmable lighting using a dimmable LED module configured for electrical connection with an AC mains power supply via a switch, the LED module including a plurality of activatable LED light sources configured for emitting a corresponding lighting characteristic when activated, the method including, in response to a control signal generated by a predetermined switching operation of the switch, a control unit selectably activating at least one of the plurality of LED light sources such that a plurality of lighting modes are able to be selectably output from the dimmable LED module corresponding to the at least one of the plurality of LED light sources that are selectably activated, the plurality of lighting modes being indicative of a resulting lighting characteristic emitted by the at least one of the plurality of selectably activated LED light sources corresponding to the lighting modes, and wherein, the plurality of lighting modes include at least a first lighting mode and a second lighting mode whereby the second lighting mode is indicative of a resulting lighting characteristic that is relatively dimmed compared to that of the first lighting mode.

Preferably, the resulting lighting characteristic of the second lighting mode that is relatively dimmed compared to that of the first lighting mode may include at least one of a brightness and a colour temperature of the second lighting mode.

Preferably, the present invention may include a step of configuring the plurality of LED light sources to emit different corresponding lighting characteristics when activated.

Preferably, the present invention may include a step of providing at least one of the plurality of LED light sources as a string of electrically-connected LEDs configured to be activated simultaneously.

Preferably, the present invention may include a step of providing a plurality of lighting modes each being indicative of resulting lighting characteristics that are dimmed to different magnitudes relative to that of the first lighting mode.

Preferably, the switch may include an on/off switch and the predetermined switching operation of the switch may include toggling the on/off switch between an on and off state in accordance with a predetermined timing protocol.

Preferably, in response to a control signal generated by a predetermined switching operation of the switch that that is received by the control unit, the control unit may be configured to sequentially output the plurality of lighting modes from the dimmable LED module for user selection, said sequential output being in order of increasing or decreasing magnitude of dimming of the resulting lighting characteristic relative to that of the first lighting mode.

Preferably, the resulting lighting characteristic indicated by the first lighting mode may include a lighting characteristic of a cool white LED light source that is selectably activated from amongst the plurality of LED light sources, and, the resulting lighting characteristic indicated by the second lighting mode includes a lighting characteristic of a warm white LED light source that is selectably activated from amongst the plurality of LED light sources.

Preferably, the present invention may include a step of configuring the control unit such that, in response to a control signal generated by a predetermined switching operation of the switch, at least one of the plurality of LED light sources is able to be selectably activated by the control unit such that a plurality of mood lighting modes are able to be selectably output from the dimmable LED module corresponding to the at least one of the plurality of LED light sources that are selectably activated, the plurality of mood lighting modes being indicative of a resulting lighting characteristic emitted by the at least one of the plurality of selectably activated LED light sources corresponding to the mood lighting modes.

Preferably, the control unit may include a power supply driver circuit for driving the plurality of LED light sources.

Preferably, the plurality of LED light sources may include at least one of a common thermal dissipation unit, a common optical unit and a common driver circuit unit.

Preferably, the dimmable LED module may be configured as a compact and/or portable lighting module.

BRIEF DESCRIPTION OF THE DRAWINGS

The present invention will become more fully understood from the following detailed description of a preferred but non-limiting embodiment thereof, described in connection with the accompanying drawings, wherein.

DETAILED DESCRIPTION OF THE PREFERRED EMBODIMENTS

Figure 3:
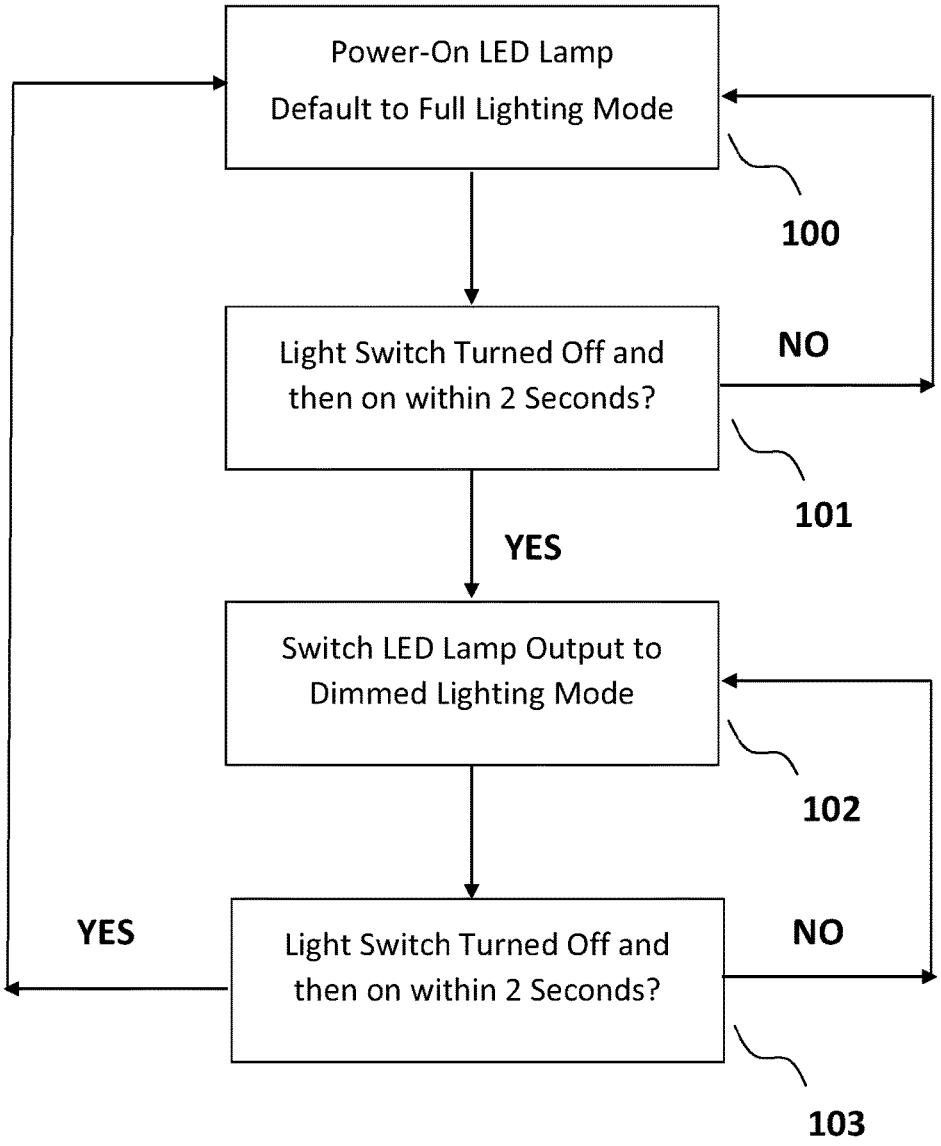
FIG. 3 depicts an exemplary flow diagram of operation of the first embodiment compact and portable dimmable LED lamp module in accordance with a first embodiment of the present invention.

Preferred embodiments of the present invention will now be described herein with reference to the FIGS. 1 and 3.

Figure 1:
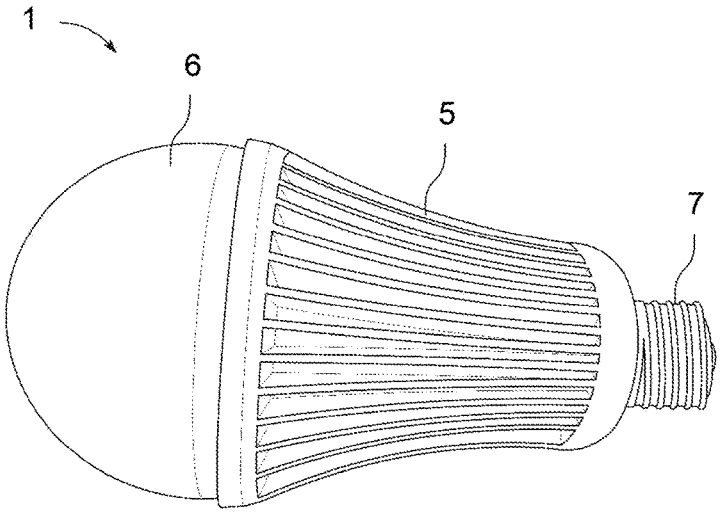
FIG. 1 depicts an exemplary compact and portable dimmable LED lamp module in accordance with a first embodiment of the present invention.
Figure 2:
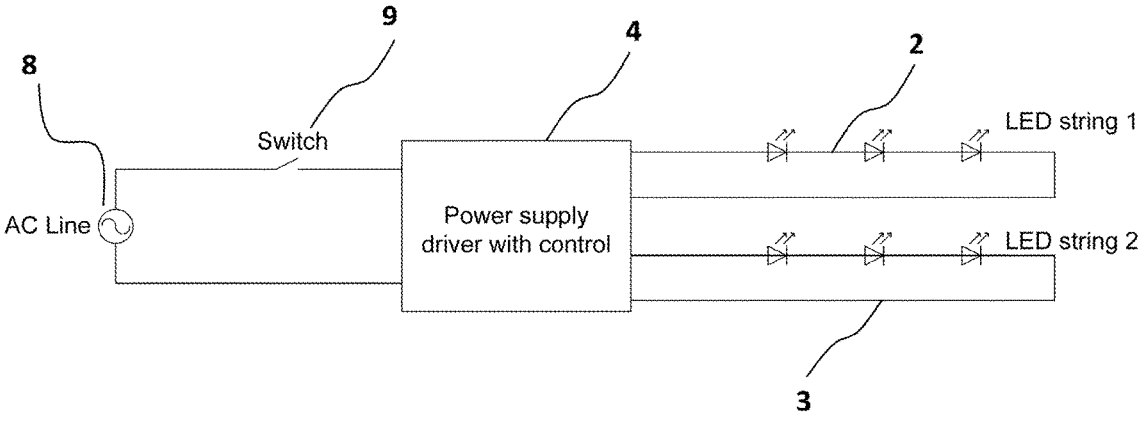
FIG. 2 depicts an exemplary circuit diagram of a first embodiment compact and portable dimmable LED lamp module in accordance with a first embodiment of the present invention.

An exemplary embodiment of the present invention is represented in FIGS. 1 and 2 in the form of a compact and portable dimmable LED lamp (1). The LED lamp (1) includes a metal backed printed circuit board (MBPCB) having first and second LED strings (2,3) operably-mounted thereon, a control unit (4) such as a microprocessor with integrated AC power supply driver circuitry for selectably activating the first and second LED strings (2,3), a multi-finned heat sink (5) for thermally-dissipating heat generated by the first and second LED strings (2,3) to the ambient air, and an optical element (6) such as a diffusion cover for suitably diffusing light emitted from the lamp. The LED lamp (1) also includes electrical contacts (7) configured for electrically-interfacing the LED lamp (1) with a lamp socket of an existing wall or ceiling installation such that the LED lamp (1) is able to be powered by an AC mains power supply (8) via an existing on/off light switch (9) of the existing installation. The electrical contacts (7) in this embodiment includes a screw thread connection member as shown in FIG. 1 to effect releasable attachment of the LED lamp (1) with the LED lamp socket.

In this exemplary embodiment, the lighting characteristics of the first LED string (2) are different and contrasting to that of the second LED string (3). By way of example, the first LED string (2) includes a string of all warm white LEDs having a lighting characteristic of 350LM at 2700K colour temperature. In contrast, the second LED string (3) includes a string of all cool white LEDs having lighting characteristics of 450LM at 5000K colour temperature. The LED lamp (1) may also be configured such that different LED strings will have different lumen flux as well as different colour temperatures. For instance in alternative embodiments, in the case of two LED strings, the warm white LEDs may be configured in a range of 10%~60% of total lumen flux in the full lighting mode at 2200K~3000K colour temperature whereas the cool white LEDs may be configured in a range of 40%~90% of total lumen flux at 4000K~7000K colour temperature, to create different lighting effects for the "dimmed lighting" and the "full lighting" modes.

In this embodiment, the LED lamp (1) is configured to operate in one of two different lighting modes—that is:

(i) A "full lighting" mode whereby both of the first and second LED strings (2,3) are selectably activated by the control unit (4) simultaneously so as to output a resulting lighting characteristic of 800LM flux at 4000K; and (ii) A "dimmed lighting" mode whereby only the first LED string (2) is selectably activated by the control unit (4) so as to output a resulting lighting characteristic of 350LM at 2700K.

Conveniently, the relative maximum brightness and high colour temperature provided by the cool white LEDs which has high components of blue light is perceived to be a particularly desirable lighting effect for reading, working or other cases which require a brighter and "fresher" lighting environment. In contrast, the dimmed lighting mode provided by the warm white LEDs lends itself to representing low or warm colour temperatures are perceived to be desirable for evoking a "cosy" environment.

Advantageously, in this embodiment, as both the first and second LED strings are selectably activated in the "full lighting" mode, the first and second LED strings (2,3) are configured to share the same control unit (4) and integrated power supply driver circuitry, the same heat sink for thermal dissipation, and the same optics (6). Conveniently, the reduced number of components not only assists in allowing for a relatively compact and portable design of the LED lamp (1) but also reduces the overall manufacturing costs and complexity of embodiments of the present invention.

The control unit (4) is programmed with a default setting such that, when the LED lamp (1) is powered on for the first time from the AC mains power supply, the integrated driver circuitry selectably activates both the first and second LED strings simultaneously to output the "full lighting" mode is output initially from the LED lamp (1). This step is represented by block 100 in FIG. 3. Thereafter, the existing light switch (9) typically mounted on a wall panel in the existing installation which electrically connects the LED lamp (1) to the AC mains power supply is conveniently utilised to control further operation of the output lighting modes of the LED lamp (1) without requiring installation and configuring of any additional/alternative costly and complex control hardware and wiring. For instance, when the LED lamp (1) is operating in full-lighting mode and the light switch (9) is turned off and then within a predetermined time interval (e.g. 2 seconds) turned on again, the control unit (4) is programmed to sense the electrical signal waveform generated by this specific predetermined switching operation whereby it changes the output of the LED lamp (1) to the "dimmed lighting" mode by selectably activating only the first LED string. This step is represented by block 101 in FIG. 3. Thereafter, when the LED lamp (1) is operating in the "dimmed lighting" mode and the light switch (9) is turned off and turned on again within the predetermined time interval (e.g. 2 seconds), the control unit (4) again senses the switching waveform generated by this switching operating and changes the output of the LED lamp (1) to the "full lighting" mode by selectably activating both the first and second LED light strings. This step is represented by block 102 in FIG. 3. As can be seen, the novel design of embodiments of the present invention utilises the on/off light switch (9) of an existing installation is utilised to quickly and easily effect control of the dimming function of the LED lamp and this alleviates any need for complex and costly installation of phase-cut dimmer circuitry, associated controller units, controller interfaces and electrical wiring.

The control unit (4) is also programmed to sense when the switch (9) has been turned to an off position for longer than 2 seconds in which case the default programming of the control unit (4) is configured to selectably output a lighting mode which is the same as that before the switch was switched-off longer than 2 seconds. This step is represented by block 103 in FIG. 3. The microprocessor of the control unit (4) will have on-chip memory which will allow the control unit (4) to remember the last lighting mode before the switch was turned off for longer than 2 seconds. Alternatively, for simplicity without this memory function, the LED lamp (1) could also be configured to simply restart in the default "full lighting" mode when the switch (9) has been turned off for longer than 2 seconds and then is turned on again. Yet alternatively, in embodiments in which there are more than two lighting modes of varying dimming output levels, the control unit (4) may be configured to restart at a default output lighting mode at a mid-range between the full lighting mode and a maximum dimmed lighting mode of the LED lamp (1).

For ease of understanding, the embodiments described herein have only utilised two LED strings having different lighting characteristics. However, it would be appreciated and understood that more than two different LED strings with different lighting characteristics can be readily utilised with the greater the number of LED strings that are utilised providing a greater selection of discrete dimmed lighting modes that may be selectably output from the LED lamp (1) by a user. The control unit (4) can be programmed to sequentially output the plurality of lighting modes in order of increasing or decreasing amount of dimming for user selection. The sequential switching from one lighting mode to another in order of increasing or decreasing amount of dimming is triggered upon sensing of an electrical signal waveform generated by a predetermined switching operation of the light switch (9) that is sensed by the control unit (4). For instance, in this embodiment, the control unit (4) is configured to sequentially switch from one lighting mode to another for user selection in order increasing or decreasing amount of dimming by sensing of the switch (9) being switched on and then off again within a 2 second time interval.

In alternative embodiments of the present invention, the predetermined operation of the switch which can be utilised to trigger the control unit (4) to selectably activate the first and second LED strings (2,3) could include amongst other things the number of times the switch is toggled (or otherwise switched amongst various possible operational states) in a given time period, the speed of toggling of the switch, and variations in the speed of successive toggling of the switch, or any combination of such operations. Where the predetermined operation of the switch involves variation in speed of a series of successive toggles of the switch between operational states, this could involve for instance:

(i) one relatively fast toggle from the on position to the off position followed by a relatively slow toggle from the off position to the on position; or (ii) one relatively slow toggle from the on position to the off position followed by a relatively fast toggle from the off position to the on position; or (iii) one relatively slow toggle from the on position to the off position followed by another relatively slow toggle from the off position to the on position; or (iii) one relatively fast toggle from the on position to the off position followed by another relatively fast toggle from the off position to the on position.

It would be appreciated from the above example, based on only an existing on/off toggle switch, already four different predetermined switching operations can be utilised to trigger operation of the control unit (4). Thus, in embodiments where there may be more than 2 LED strings used and more than two lighting modes (for instance four lighting modes), rather than configuring the control unit (4) to switch sequentially from one lighting mode to another for user selection, the desired lighting output can be immediately selected by inputting one of the above four predetermined switching operations of the on/off toggle switch to the control unit (4) which is configured to recognise the appropriate lighting mode to output. It would be appreciated that the already installed switch of the existing installation that is used to trigger the control unit (4) operation need not be limited to a simple on/off switch which toggles between only on and off operational states. The switch could include more than two operational states or could include different types of switching mechanisms (such as a switch that is rotatable between varying operational states etc.). If such alternative switches are utilised then the control unit (4) can be readily configured to sense any number of different predetermined switching operations which may be effected utilising these alternative types of switches.

Whilst in this embodiment, two separate LED strings are utilised, in other embodiments, it is possible for two single LEDs to used. In other embodiments, a single LED light source could be utilised in combination with suitably configured optics designed to split output light emissions from the single LED to multiple output lighting channels having differing lighting characteristics. The optics could be controlled by the control unit (4) to selectably output different lighting modes from the LED lamp (1).

Conveniently, LED lamp embodiments of the present invention may be configured to serve a dual-purpose as a light dimming operation as well as a mood lighting operation which may be simply and conveniently controlled by an existing light switch (9). That is, the control unit (4) can be programmed to switch to "mood lighting" operation from "dimming" operation upon sensing of a predetermined switching waveform signal generated by operation of the light switch (9)—for instance this could be effected by quickly toggling the light switch (9) on and off three times in succession. Once in mood lighting operation, the control unit (4) could be programmed to output a plurality of preprogrammed mood lighting modes comprising selectably activated combinations of LED strings which produce suitable mood lighting characteristics. The output of such mood lighting modes can be sequentially output for user selection in similar manner as described above for sequentially outputting dimmed lighting modes.

By way of example, the embodiments of the present invention can be configured to firstly switch to a mood lighting mode from the light dimming mode by inputting a predetermined control input to the control unit (4) of the LED lamp. Thereafter, a plurality of preprogrammed mood lighting modes may thereafter be sequentially output from the LED lamp for user selection in response to a further predetermined control input being inputted to the control unit (4) by user operation of the light switch (9). With a greater number of LED light sources implemented in the LED lamp (1) of varying colour temperature and/or brightness, the number of different possible mood lighting modes which maybe output by colour temperature mixing will be similarly increased.

It will be apparent that embodiments of the present invention provide a number of advantages including that:

1. in contrast to existing technologies which are trending towards increasingly functional complexity and increasing associated costs of installation/implementation, the dimmable LED lamp (1) embodiment of the present invention provides a relatively simple and practical dimmable lighting solution which may be utilised by simply plugging the LED lamp (1) in to an existing LED lamp socket installation and then conveniently controllably dimmed by predetermined switching operation of the existing light switch (9) without requiring the installation of any complex and costly phase-cut dimmer circuitry, control units, control interfaces, electrical wiring, and switches to provide the dimming function;
2. the dimmable LED lamp (1) conveniently provides a dual-function as a mood lighting device due to the ability of the control unit (4) to selectably activate LED strings of different brightness and/or colour temperature;
3. the dimmable LED lamp (1) has a compact design due to the first and second LED strings the same control unit (4) and integrated power supply driver circuitry, the same heat sink for thermal dissipation, and the same optical assembly;
4. cost and complexity of manufacture of the LED lamp (1) is reduced due to the fewer components that may be used.

Those skilled in the art will appreciate that the invention described herein is susceptible to variations and modifications other than those specifically described without departing from the scope of the invention. All such variations and modification which become apparent to persons skilled in the art, should be considered to fall within the spirit and scope of the invention as broadly hereinbefore described. It is to be understood that the invention includes all such variations and modifications. The invention also includes all of the steps and features, referred or indicated in the specification, individually or collectively, and any and all combinations of any two or more of said steps or features.

The reference to any prior art in this specification is not, and should not be taken as, an acknowledgment or any form of suggestion that that prior art forms part of the common general knowledge.

What is claimed is:

1. A dimmable LED module configured for electrical connection with an AC mains power supply via a switch, the dimmable lighting module being configured as a compact and portable lighting module and including:

a plurality of activatable LED light sources configured for emitting a corresponding lighting characteristic when activated; and a control unit configured for selectably activating at least one of the plurality of LED light sources in response to a control signal generated by a predetermined switching operation of the switch that is received by the control unit such that a plurality of lighting modes are able to be selectably output from the dimmable LED module corresponding to the at least one of the plurality of LED light sources that are selectably activated by the control unit, the plurality of lighting modes being indicative of a resulting lighting characteristic emitted by the at least one of the plurality of selectably activated LED light sources corresponding to the lighting modes;

the plurality of lighting modes including at least a first lighting mode and a second lighting mode whereby the second lighting mode is indicative of a resulting lighting characteristic that is relatively dimmed or adjusted compared to that of the first lighting mode; and wherein the switch includes an on/off type switch and the predetermined switching operation used to generate the control signal for controlling which of the plurality of lighting modes is selectably output from the dimmable LED module includes variations in the speed of successive toggling of the switch.

2. A dimmable LED module as claimed in claim 1 wherein the resulting lighting characteristic of the second lighting mode that is relatively dimmed compared to that of the first lighting mode includes at least one of a brightness and a colour temperature of the second lighting mode.

3. A dimmable LED module as claimed in claim 1 wherein the plurality of LED light sources are configured for emitting different corresponding lighting characteristics when activated.

4. A dimmable LED module as claimed in claim 1 wherein at least one of the plurality of LED light sources include a string of electrically-connected LEDs configured to be activated simultaneously.

5. A dimmable LED module as claimed in claim 1 including a plurality of lighting modes each being indicative of resulting lighting characteristics that are dimmed or adjusted to different magnitudes relative to that of the first lighting mode.

6. A dimmable LED module as claimed in claim 1 wherein in response to a control signal generated by a predetermined switching operation of the switch that is received by the control unit, the control unit is configured to sequentially output the plurality of lighting modes from the dimmable LED module for user selection.

7. A dimmable LED module as claimed in claim 1 wherein the resulting lighting characteristic indicated by the first lighting mode includes a lighting characteristic of a cool white LED light source that is selectably activated from amongst the plurality of LED light sources, and, the resulting lighting characteristic indicated by the second lighting mode includes a lighting characteristic of a warm white LED light source that is selectably activated from amongst the plurality of LED light sources.

8. A dimmable LED module as claimed in claim 1 wherein in response to a control signal generated by a predetermined switching operation of the switch that is received by the control unit, the control unit is configured for selectably activating at least one of the plurality of LED light sources such that a plurality of mood lighting modes are able to be selectably output from the dimmable LED module corresponding to the at least one of the plurality of LED light sources that are selectably activated, the plurality of mood lighting modes being indicative of a resulting lighting characteristic emitted by the at least one of the plurality of selectably activated LED light sources corresponding to the mood lighting modes.

9. A dimmable LED module as claimed in claim 1 wherein the plurality of LED light sources include at least one of a common thermal dissipation unit, a common optical unit and a common driver circuit unit.

10. A method for providing dimmable lighting using a dimmable LED module configured for electrical connection with an AC mains power supply via a switch, the LED module being configured as a compact and portable lighting module and including a plurality of activatable LED light sources configured for emitting a corresponding lighting characteristic when activated, the method including, in response to a control signal generated by a predetermined switching operation of the switch, a control unit selectably activating at least one of the plurality of LED light sources such that a plurality of lighting modes are able to be selectably output from the dimmable LED module corresponding to the at least one of the plurality of LED light sources that are selectably activated, the plurality of lighting modes being indicative of a resulting lighting characteristic emitted by the at least one of the plurality of selectably activated LED light sources corresponding to the lighting modes, the plurality of lighting modes include at least a first lighting mode and a second lighting mode whereby the second lighting mode is indicative of a resulting lighting characteristic that is relatively dimmed or adjusted compared to that of the first lighting mode-, and wherein, the switch includes an on/off type switch and the predetermined switching operation used to generate the control signal for controlling which of the plurality of lighting modes is selectably output from the dimmable LED module includes variations in the speed of successive toggling of the switch.

11. A method as claimed in claim 10 wherein the resulting lighting characteristic of the second lighting mode that is relatively dimmed or adjusted compared to that of the first lighting mode includes at least one of a brightness and a colour temperature of the second lighting mode.

12. A method as claimed in claim 10 including a step of configuring the plurality of LED light sources to emit different corresponding lighting characteristics when activated.

13. A method as claimed in claim 10 including a step of providing at least one of the plurality of LED light sources as a string of electrically-connected LEDs configured to be activated simultaneously.

14. A method as claimed in claim 10 including a step of providing a plurality of lighting modes each being indicative of resulting lighting characteristics that are dimmed or adjusted to different magnitudes relative to that of the first lighting mode.

15. A method as claimed in claim 10 wherein in response to a control signal generated by a predetermined switching operation of the switch that is received by the control unit, the control unit is configured to sequentially output the plurality of lighting modes from the dimmable LED module for user selection.

16. A method as claimed in claim 10 wherein the resulting lighting characteristic indicated by the first lighting mode includes a lighting characteristic of a cool white LED light source that is selectably activated from amongst the plurality of LED light sources, and, the resulting lighting characteristic indicated by the second lighting mode includes a lighting characteristic of a warm white LED light source that is selectably activated from amongst the plurality of LED light sources.

17. A method as claimed in claim 10 including a step of configuring the control unit such that, in response to a control signal generated by a predetermined switching operation of the switch, at least one of the plurality of LED light sources is able to be selectably activated by the control unit such that a plurality of mood lighting modes are able to be selectably output from the dimmable LED module corresponding to the at least one of the plurality of LED light sources that are selectably activated, the plurality of mood lighting modes being indicative of a resulting lighting characteristic emitted by the at least one of the plurality of selectably activated LED light sources corresponding to the mood lighting modes.

18. A method as claimed in claim 10 wherein the plurality of LED light sources include at least one of a common thermal dissipation unit, a common optical unit and a common driver circuit unit.

* * * * *